US007624507B2

(12) United States Patent
Bergstrand

(10) Patent No.: US 7,624,507 B2
(45) Date of Patent: Dec. 1, 2009

(54) HAND-HELD CUTTING DEVICE

(75) Inventor: Martin Bergstrand, Karlstad (SE)

(73) Assignee: ES Equipment AB, Karlstad (SE)

( * ) Notice: Subject to any disclaimer, the term of this patent is extended or adjusted under 35 U.S.C. 154(b) by 423 days.

(21) Appl. No.: 11/618,999

(22) Filed: Jan. 2, 2007

(65) Prior Publication Data

US 2008/0155838 A1 Jul. 3, 2008

(51) Int. Cl.
*B26B 29/02* (2006.01)

(52) U.S. Cl. ..... 30/294; 30/280

(58) Field of Classification Search ..... 30/280, 30/282, 284, 285, 286, 289, 292, 293, 294
See application file for complete search history.

(56) References Cited

U.S. PATENT DOCUMENTS

| | | | | | |
|---|---|---|---|---|---|
| 3,613,241 | A * | 10/1971 | Allen | 30/294 |
| 3,673,687 | A * | 7/1972 | Phillips et al. | 30/294 |
| 3,748,742 | A * | 7/1973 | Bigler et al. | 30/294 |
| 3,839,788 | A * | 10/1974 | Addis | 30/287 |
| 4,157,617 | A * | 6/1979 | Frith | 30/294 |
| 4,283,853 | A * | 8/1981 | Fazzini | 30/265 |
| 4,813,141 | A * | 3/1989 | Funger | 30/290 |
| D323,278 | S * | 1/1992 | Zwick | D8/98 |
| 5,485,677 | A * | 1/1996 | Seber | 30/294 |
| 5,737,842 | A * | 4/1998 | Freedman | 30/280 |
| 5,881,463 | A * | 3/1999 | Casteel et al. | 30/280 |
| 6,308,421 | B1 * | 10/2001 | Wang | 30/178 |
| 6,691,416 | B2 * | 2/2004 | Yu Chen | 30/294 |
| 2002/0069733 | A1 * | 6/2002 | Allenberg et al. | 83/13 |
| 2006/0150426 | A1 * | 7/2006 | Okada | 30/287 |
| 2008/0016702 | A1 * | 1/2008 | Domenico | 30/294 |
| 2008/0104851 | A1 * | 5/2008 | Roberts | 30/289 |

* cited by examiner

*Primary Examiner*—Hwei-Siu C Payer
(74) *Attorney, Agent, or Firm*—Jeffrey S. Melcher; Menelli Denison & Selter PLLC

(57) ABSTRACT

This invention relates to a hand held cutting device comprising a handle (62), a cutting head (63), a cutting element (4) attached to the cutting head (63), and a guiding and supporting element (2) extending from the cutting head (63). The guiding and supporting element (2) and cutting head (63) are arranged to form a protecting periphery (100) such that any part of a cutting edge (4A) of the cutting element (4) does not protrude outside of said periphery. The guiding and supporting element (2) includes a distal portion (2A) arranged to form a feed channel (64) together with a portion (60) of the handle (62) and a support device (1) is arranged on the guiding and supporting element (2). The support device (1) is arranged to interact with the cutting edge (4A) to improve cut ability, wherein the cutting element (4) is arranged to be none rotatably, fixedly attached to the cutting head (63) by means of a locking device (40, 41) that provides for at least three different re-positioning and thereby renewing of the cutting edge (4*a*).

10 Claims, 7 Drawing Sheets

HAND-HELD CUTTING DEVICE

TECHNICAL FIELD

This invention relates to a hand held cutting device, more particularly, to a cutting device especially adapted for cutting textile type of material e.g. clothes.

In accident situations with a suspected injury it could be very important to liberate a victim of the accident from his clothes for diagnosis purposes or instantaneous treatment. Additionally, when there is e.g. exposure to dangerous chemicals it could also be very important to liberate the victim from his clothes if they have been soaked with such chemicals.

The device according to the invention could of course be used in other situations and for cutting e.g. rugs, carpets, mats, and other fabrics and work pieces as well. A particular use is for quickly removing e.g. tape and bandages used in the sport environment. Another use is for rapid severing of a safety or seat belt of a motor vehicle to release a passenger there from in the event of an emergency.

BACKGROUND ART

Cutting devices for one or the other of the above mentioned purposes are previously known. U.S. Pat. No. 4,631,829 for instance describes a holder for a conventional single-edge razor blade used to cut thin, elongated articles. The cutting edge of the blade is protected except for a portion thereof, which is exposed at the end of a guide slot in the holder. The blade is replaceable without tools and is reversible to use portions of both ends. One of the disadvantages of this holder is that the blade has to be dismounted when shifting to a new edge on the same blade. Additionally there is only two possible positions for the blade which gives only two fresh independent cutting edges per blade.

Another similar cutting device is known from U.S. Pat. No. 2,537,287. Also in this device the blade is replaceable without tools and is reversible to use portions of both ends. The disadvantages of this device of the same as listed above.

The patent specification U.S. Pat. No. 3,673,687 describes a bandage cutter and more particularly the cutter for removing the tape that is routinely applied to the wrists and ankles of athletes. This cutting device is provided with a cutting element of special and complicated design. The cutting element can be dismounted without using any tools but there is no possibility to shift the position of the element in order to expose and new fresh portion of the cutting edge.

From the prior art there is also known a cutting device having a cutting element in the form of a free rotating circular disc which co-operates with an opposed free roller fixed on a pivoting arm. By means of an adjustment mechanism the position of said arm and thereby the roller in relation to the cutting element can be set. The work piece to be cut passes between the cutting element and the roller. An essential disadvantage with this device is of course the complicated design with several moving elements and adjustment needs. Additionally, the efficiency of the device is poor due to the rotating movement of the cutting element.

BRIEF DESCRIPTION OF THE INVENTION

The cutting device according to the invention which solves the problems with the devices according to the prior art is especially designed to handle textile material of different types, also in several layers, as well as e.g. leather, rubber, belts and plastic/metal zippers. At the same time it is, due to its design, very safe for the user.

One object of the invention is to provide a cutting device having at least three possible positions for the associated cutting element which gives fresh independent cutting edges.

Another object of the invention is to provide a cutting device making it possible to shift to a new edge on the same cutting element without tools and without dismounting the cutting element from the cutting head which reduces the risk of injuries to the operator and damages to the cutting element itself.

A further object is to provide a cutting device making it possible to replace the cutting element without tools.

A still further object is to provide a cutting device without moving parts. In this context it has surprisingly been observed that a non rotating cutting edge in most situations provides a more efficient cutting operation than a rotate able cutting edge.

A still further object is to provide a cutting device having a support surface for the workpiece which is easily exchangeable without tools making it possible to design a feed channel for the work piece optimising the cutting characteristics of the cutting device for any particular material and environment. In this context it has surprisingly been observed that a non-rotating, interactive support surface in most situations provides a more efficient cutting operation than a rotatable support surface.

A still further object is to provide a cutting device making it possible to change the type, especially the form (polygonal) of the cutting element without making other changes to the cutting device.

A still further object is to provide a cutting device giving an indication informing when to replace the cutting element.

A still further object is to provide a cutting device eliminating the risk of clogging during the cutting procedure.

A still further object is to provide a cutting device presenting an active cutting edge having an instantaneous decrease of the cutting angle in the feeding direction increasing the cutting efficiency for certain materials.

A still further object is to provide a cutting device presenting an ergonomic design.

The present invention, which provides a solution to the said technical problems, is characterised according to the appended claims.

BRIEF DESCRIPTION OF THE FIGURES

Other objects, uses and advantages of this invention will be apparent from the reading of this description which proceeds with reference to the accompanying drawings forming part thereof and wherein.

DETAILED DESCRIPTION OF THE INVENTION

Figure 1:
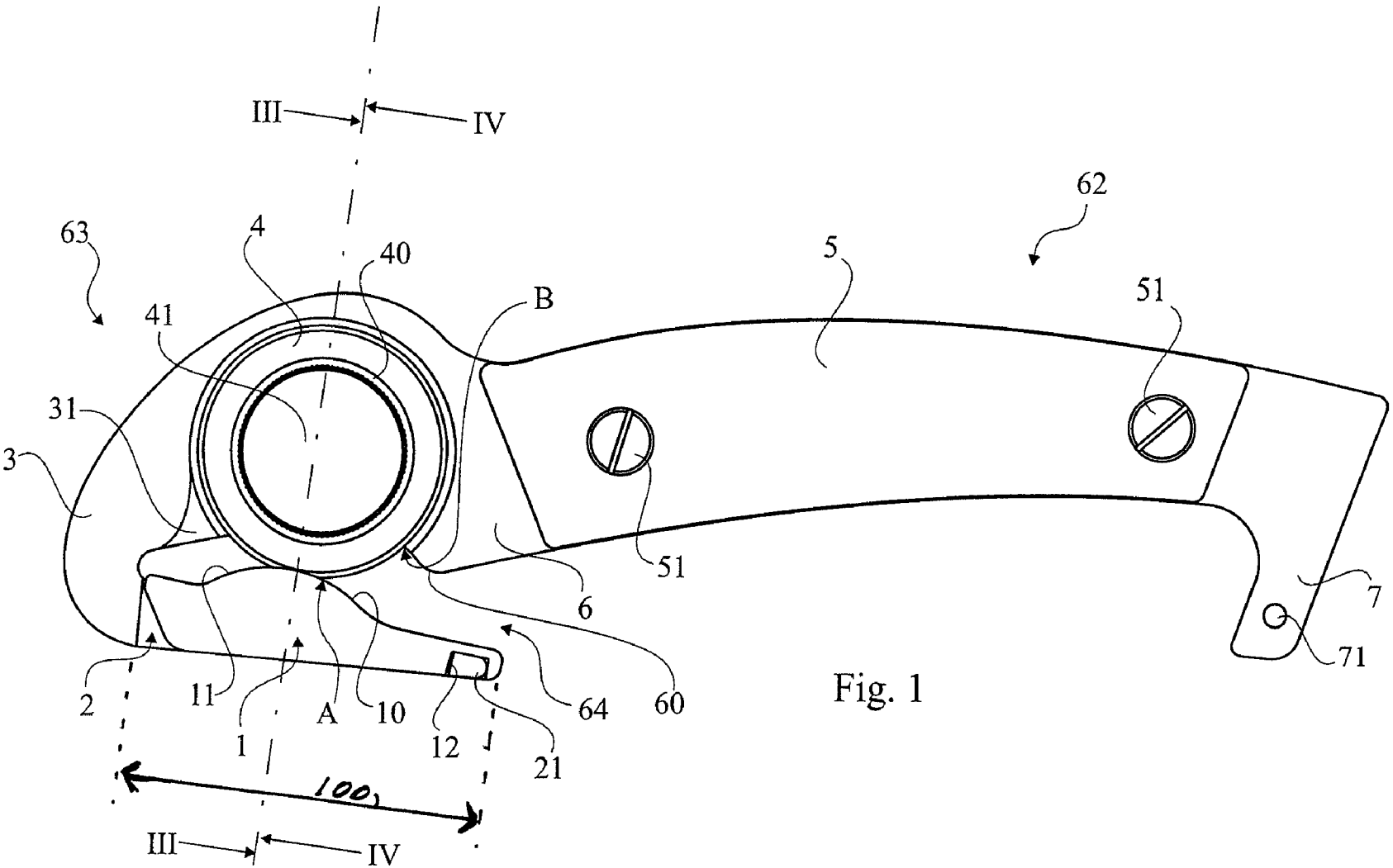
FIG. 1 shows a side view of an embodiment of the cutting device according to the invention.
Figure 2:
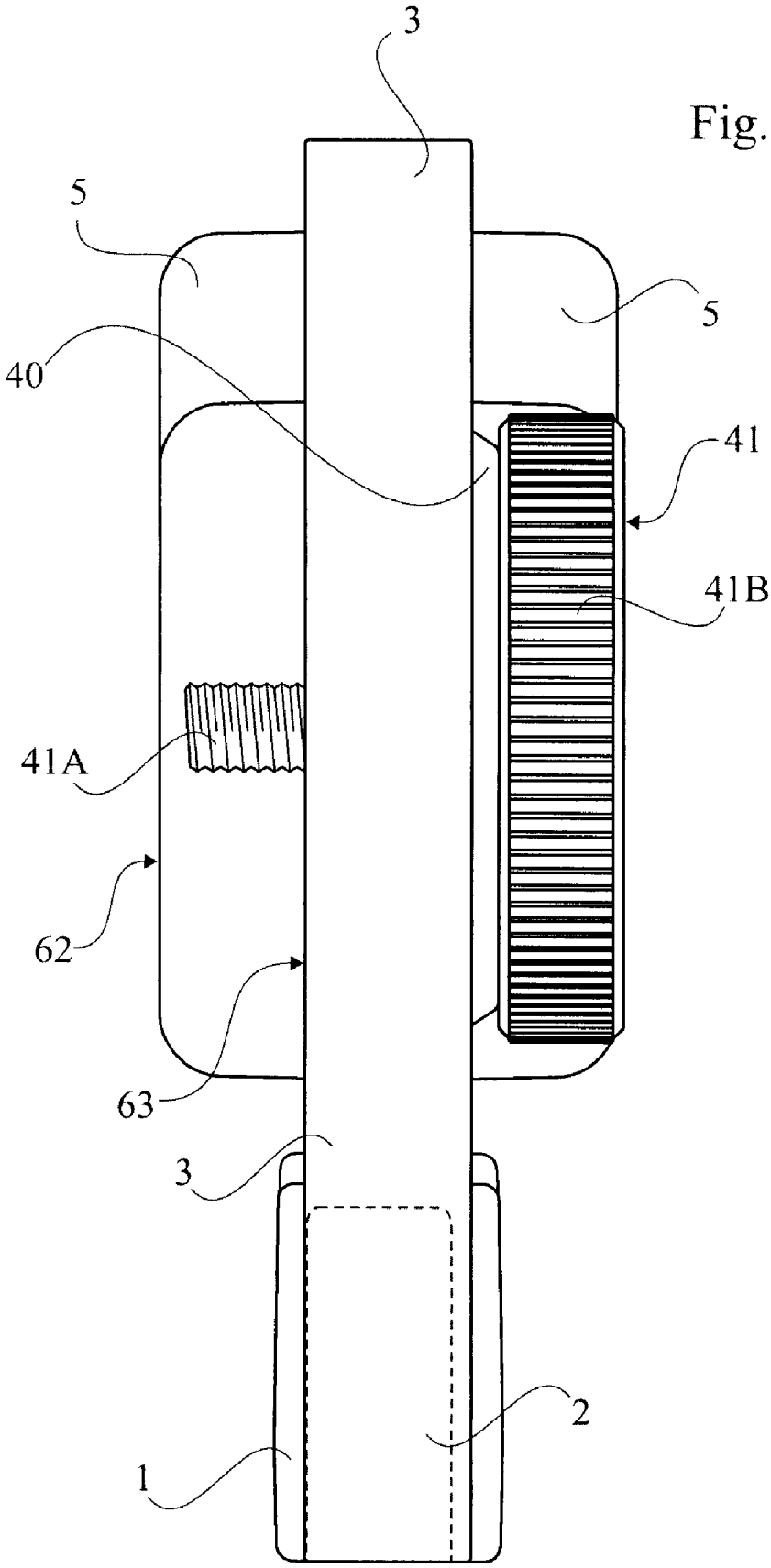
FIG. 2 shows a side view of the cutting device corresponding to a view from the left in FIG. 1.

FIG. 1 shows a side view of an embodiment of the cutting device according to the invention.

Figure 7:
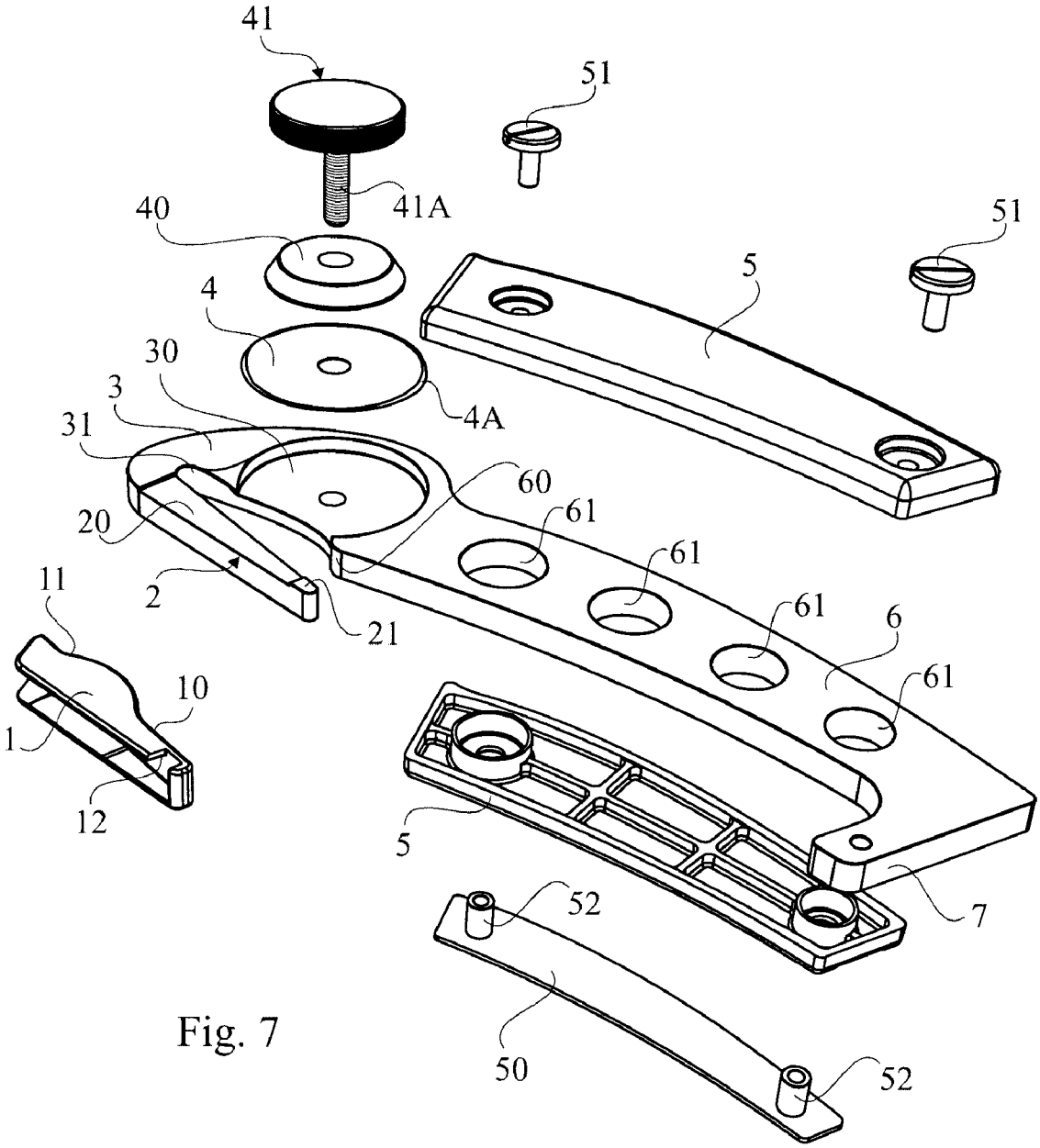
FIG. 7 shows an exploded view of the same embodiment of the invention.

The cutting device according to the invention comprises a main body 6 which is more clearly shown in FIG. 7 integrating a handle 62 and a cutting head 63 extending from the front end of the handle. At the rear end of the handle a glide stop 7 is arranged for making the grip more secure when pulling. The main body has to be made of a strong rigid material such as aluminium, brass, steel, plastic, especially reinforced plastic like e.g. carbon reinforced plastic resin or the like. In one embodiment the main body 6 has been machined in a piece of aluminium. As can be seen from the figures the handle has been given a somewhat curved form which together with the protruding glide stop 7 (preferably forming a sharp angle $\alpha$ in relation to the extension of the main body 6) together with handle covers 5, cf. FIG. 7, fixed on each side of the main body results in a ergonomic design especially adapted for pulling. By using handle covers many advantages may be achieved, e.g. optimisation of the thickness (preferably in the range 4-10 mm, more preferred 8 mm or less) than of the main body (i.e. material savings) from other aspects than comfort. The handle 5,6 on the cutting device according to the invention gives a good grip for different sizes of hands with and without gloves and further provides extra secure gripping (if desired), by having the main body 6 arranged with finger holes 61, which are grip able when removing the handle covers 5. The covers 5 are easily removed by unscrewing the attachment screws 51 from one and the same side (which also makes production more efficient), thanks to having the threaded portions 52 fixedly attached on a cover plate 50.

Figure 4:
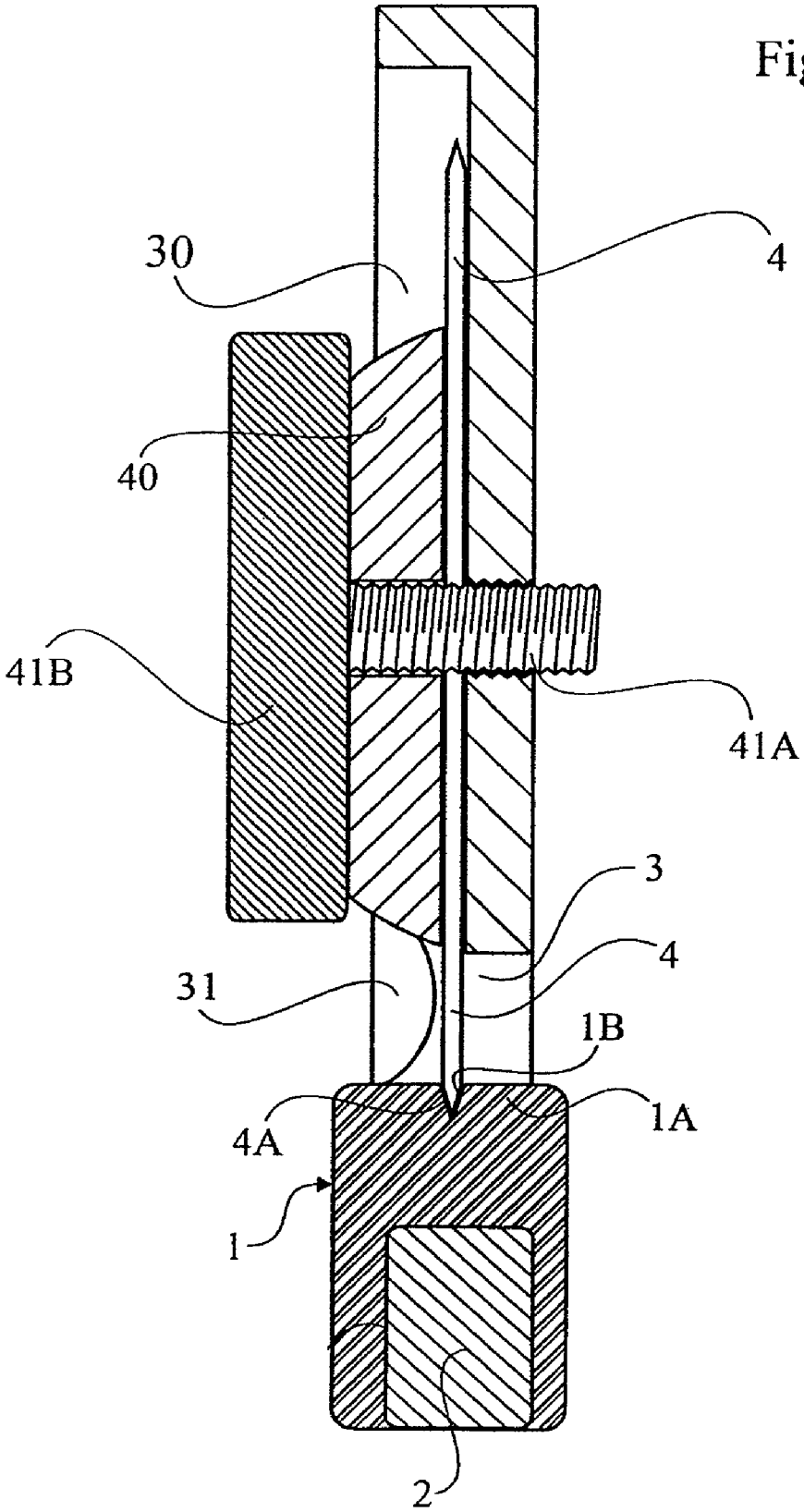
FIG. 4 shows the cutting device in section along the line marked IV-IV in FIG. 1.

The active part of the device is the cutting head 63 provided with a recess 30 in the main body 6, cf. for instance FIG. 4, for receiving and accommodating the thin cutting element 4 made of stainless steel, ceramics or the like. The cutting element 4 is in the cutting procedure co-operating with an associated support and guiding element 1, 2 which reaches from the front end 3 of the cutter underneath the cutting element 4 in the direction of the handle 62. In the preferred embodiment the support and guiding element 1, 2 includes core member 2 that is fixedly attached to the cutter head 63, preferably by being integral with the main body 3 of the cutter head 63.

The recess 30 in the cutting head 63 which is receiving and protecting the cutting element 4 has in the enclosed figures been represented with a circular form with a centre hole which is the most suitable. The cutting element 4 which in the appended drawings also has a circular form (a generally available standard element that may be obtained to a low price) with a somewhat smaller diameter. Of course the cutting element could as a matter of fact have a number of other suitable forms. However, a general principle is to arrange the cutting element 4 attached to said cutting head 63 and position the guiding and supporting element 2 to form a protecting periphery 100 such that any part of a cutting edge 4A of said cutting element 4 does not protrude outside of said periphery 100.

According to the inventive idea the cutting element 4 could also e.g. have a triangular form, a square form or in principle any regular polygonal form possible to inscribe in a circle with the same diameter as the cutting element shown in the figures or a portion of a circular device (e.g. 90°, 180° or 270°). For each of those forms the recess 30 could be given a form to suit the cutting element but the most suitable and versatile and at the same time cheapest to make is the circular form.

There is of course a cutting edge arranged on all the polygonal sides and all vertices will have the same distance from the centre of the cutting element equal to the radius of the circular cutting element. It is understood that all those other cutting elements 4 could easily replace the circular one on the same cutting device. Each form could have its proper advantages.

Figure 5:
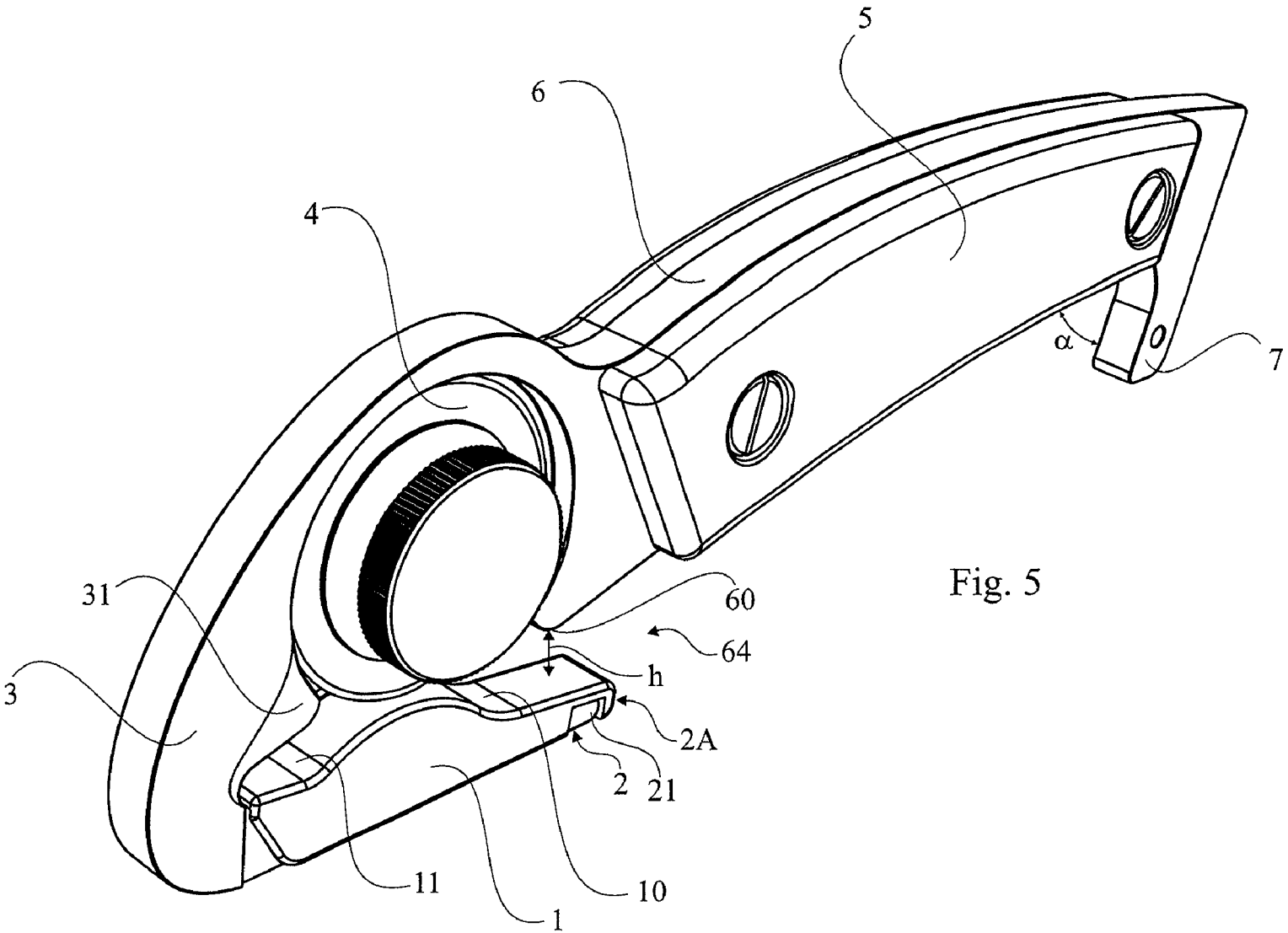
FIG. 5 shows in a perspective view the embodiment of the cutting device according to FIG. 1.
Figure 6:
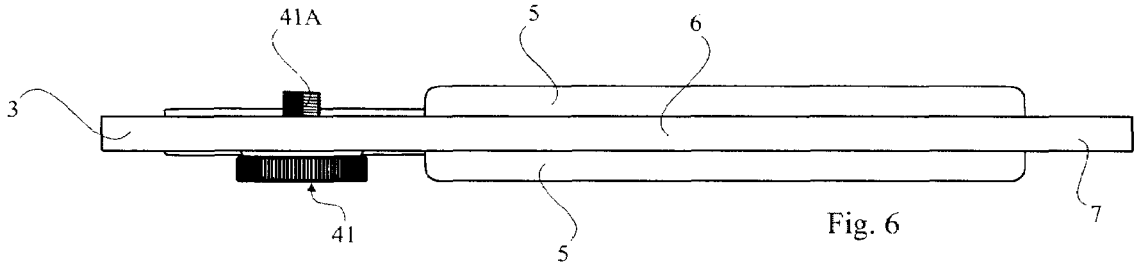
FIG. 6 shows a top view of the embodiment of the cutting device according to FIG. 1.

In the embodiment illustrated in e.g. FIGS. 1 and 5 the active exposed cutting edge or zone between the points A and B in the FIG. 1 is formed by a portion of the periphery of the circular cutting element related to a sector having an angle of somewhat less than 60 degrees. This means that the periphery of the cutting element 4 in this case comprises additionally five portions of the cutting edge which can be shifted into active position between the points A and B when the previous one has become dull. It is a major advantage of the invention that the shift to a new sharp cutting edge can be made without dismounting the cutting element 4 from the cutting head 63 which of course reduces the risk of injuries to the operator or damages to the cutting element/blade 4 itself. As will be described further on the shift does not even need a tool to be carried out.

The centre of the recess 30 is provided with a threaded hole, cf. FIG. 7, co-operating with a fixing screw 41 having a threaded portion 41A and a knurled head 41B with a relatively large diameter to make it easy to handle. A fixing element 40 (e.g. made of aluminium or a suitable polymer) is positioned between the flat underside of the head 41B of the screw 41, cf. FIG. 7, and the cutting element 4. By means of this arrangement the cutting element 4 will be clamped by the fixing element 40 against the generally flat bottom part of the recess 30 (thereby fixed by means of clamping/friction) and oriented essentially perpendicular to the co-operating support and guiding element when the screw 41 is tightened. Further the diameter of the fixing element is large to provide lateral support to the blade 4 (i.e. its diameter Df is of course smaller than that Db of the blade 4, but preferably $Df>0.5\ Db$, more preferred $0.6\ Db \leqq Df \leqq 0.8\ Db$).

The associated support and guiding element has a core in the form of an elongated member 2 forming an integral part of the main body 6 and which as mentioned reaches from the front end 3 of the cutter underneath the cutting element 4 in the direction of the handle 62. This part has advantageously the form of a wedge with the tip forming the distal end in the direction of the handle 62. The support and guiding element together with the cutting element 4 and the lower front part 60 of the handle will define a feed channel 64 having its opening in the direction of the handle for directing and feeding the work piece towards the active part of the cutting element between the points A and B in FIG. 1.

The core member 2 is provided with a removable sleeve 1, cf. for instance FIG. 7, preferably made of a suitable plastic (e.g. POM or PTFE), that provides sufficiently low friction for a cloth or the like to easily slide across it. By sliding the sleeve 1 from the right to the left in the FIG. 1 on top of and over the core member 2 the sleeve can be fixed to the latter. When mounting the sleeve 1 the cutting element 4 should already be fixed in the recess 30. The dimensions of the sleeve 1 are such that the mounted cutting element 4 will cut a slit 1B in the upper portion 1A of the support sleeve 1 when pushed onto the core member, thereby supporting the cutting edge 4A side wise and closing the feed channel 64 at the point A in the figure. Thus, the shortest distance between the upper portion 1A of the support sleeve 1 and the centre of the mounted cutting element 4 is less than the radius of the cutting element. This arrangement will also lock the sleeve vertically. In the illustrated embodiment of the invention the distal end of the elongated core member has been provided with a heel 21 co-operating with a recess 12 in the sleeve. This arrangement provides a snap-in function which will block the longitudinal movement of the sleeve on the core member 2. Additionally the cutting operation tends to push the sleeve in the longitudinal direction to the left in the FIG. 1 which is opposite to the release direction.

It is clear that there is quite some freedom of design when it comes to the profile of the support surfaces 10 and 11 in the upper portion 1A of the support sleeve 1 both before the cutting area, surface 10, and after the cutting area, surface 11. This makes it possible to design the feed channel 64 to optimise the cutting characteristics of the cutting device for any particular material and environment. Thus, different sleeves for different jobs could be provided. In this context it is an advantage to form a straight lined upper surface of the core member 2, which provides for easy production and easy attachment (by sliding) of the support sleeve and to utilise the sleeve 1 (preferably being made of a cheaper material) to form desired surfaces 10, 11.

In the illustrated embodiment with a circular cutting element 4 the feed channel 64 has been made converging with successively decreasing cutting angle with a considerable component of the cutting edge 4A in the cutting zone close to point A in the FIG. 1 almost parallel to the work piece fed through the channel 64. For this purpose the guiding and supporting element 2 includes a distal portion 2A arranged to form the most narrow gap h (e.g. maximum 12.5 mm) of the feed channel 64 together with a protruding portion 60 of the handle 62. At the side of sleeve 1 of the feed channel 64, between the gap h and point A the sleeve 1 is provided with a portion presenting a smoothly curved surface 11 that provides for a convergent zone of the feed channel 64, which provides for easy and clog free feeding of material to be cut. The surface of the handle 62 exposed to the feed channel 64, in the direction of the stop 7 but including the protruding portion 60, also extends in a manner to reduce the risk of clogging, e.g. by presenting a large general curvature (preferably larger than 50 mm) and extending to form a smooth converging zone into the feed channel 64. This arrangement has proven to be very efficient for cutting textile like materials. The feed channel 64 is also designed, except for being sufficiently narrow, sufficiently deep (preferably 5-20 mm between the narrow gap and the exposed cutting edge 4A) and also having the major portion of the cutting edge 4A hidden within a recess 30 of the cutting head 63 (preferably a substantially circular recess extending more than 200 degrees) to prevent accidental cutting contact between the exposed part of the cutting edge 4A of element 4 and any part of the hand of the user.

In order to facilitate for the cut material to leave the cutting head in the direction to the left in the figure without risk of clogging the head the sidewall 31 at the exit of the recess 30 has been bevelled.

From the above description it is clear that the cutting device is not comprising any moving parts.

The cutting element 4 which is almost entirely protected within the recess 30 could easily be repositioned in order to present a fresh active cutting edge between the positions A and B without dismounting the same. To achieve this the screw 41 with knurled head is unscrewed until the cutting element 4 looses its clamping contact with the bottom part of the recess 30 and the cutting element is rotated to the new position in which the screw 41 is again tightened. A fresh cutting edge has in this way been entered between the positions A and B. If necessary the procedure could be repeated. Alternatively the rotation of the cutting element could be achieved by first unscrewing the screw 41 as above and thereafter releasing and sliding the sleeve 1 by pulling it somewhat to the right in the FIG. 1. Hence, alternatively the friction between the cutting element and the slit in the support surface may be used to force the cutting element to rotate counter clockwise without the need to touch the same. Then the screw 41 is again tightened and the sleeve put back in position.

In order to change the cutting element 4 as a whole the screw 41 has of course to be completely unscrewed, and further there is preferably arranged a sufficient gap between the periphery of the recess 30 and the edge 4A of the blade 4 to slide the blade upwards, away from the supporting element 1 to let the blade come out of the recess 4B, where after the blade may easily be removed/exchanged.

In another embodiment, not shown in any of the figures, the cutting element 4 could in order to more precisely define the successive sectors of the cutting edge e.g. be provided with a number of holes at regular intervals on a circle around the centre hole of the cutting element 4 co-operating with a pin protruding from the bottom part of the recess 30. Each position of the cutting element 4 with the pin entering a hole will in this way correspond to a particular one of the sectors with a new cutting edge presented between the positions A and B in the FIG. 1. With the geometries given in e.g. FIG. 1 this embodiment could e.g. have six holes co-operating with the pin for shifting between six successive cutting edge sectors. In order to facilitate the release of the cutting element 4 from the pin when the screw 41 is somewhat unscrewed for the shift a spring washer could be placed between the cutting element 4 and the bottom part of the recess 30. This washer will lift the cutting element and release it from the pin. Additionally, the different sectors of the cutting edge could be marked e.g. with consecutive numbers or similar in order to identify a fully used cutting element ready for replacement.

For embodiments provided with a cutting element of polygonal form it is evident that a suitable form of the profile of the sleeve 1 could also give a feed channel 64 which is converging with successively decreasing cutting angle even if the cutting edge or edges form straight lines.

An interesting form of a polygonal cutting element is the one having twelve vertices (or more). If the circular cutting element according to the FIG. 1 for instance is replaced with such a cutting element in the position with one vertex at A in the figure there will be a second vertex around midway between the positions A and B. This means that the active cutting edge will present an instantaneous decrease of the cutting angle in the feeding direction. This characteristic is very interesting for efficient cutting of certain materials.

The cutting operation is generated by the relative movement between the cutting device and the workpiece that is e.g. a piece of textile cloth, a pile of cloth, a piece of clothing, a bandage tape, a safety belt at an accident site etc. The distal portion 2A of the guiding and support element 1,2 below the handle 62 of the cutting device is inserted underneath the work piece and the operator is pulling the cutting device essentially in parallel with the surface of the work piece. During that movement the cutting element 4 should be oriented essentially perpendicular to the surface of said work piece for the best result. The interaction between the cutting element 4 and the guiding and support element 1, 2 arranged to interact with the cutting head 63 and in contact at the end A of the feed channel 64 will achieve the cutting operation. As has been described above a suitable design of the feed channel, e.g. on the downstream side of the cutting zone e.g. by bevelling at least one of the sidewalls 31 of the main body 6 at the exit of the recess 30, will prevent clogging of the cutting head.

Figure 3:
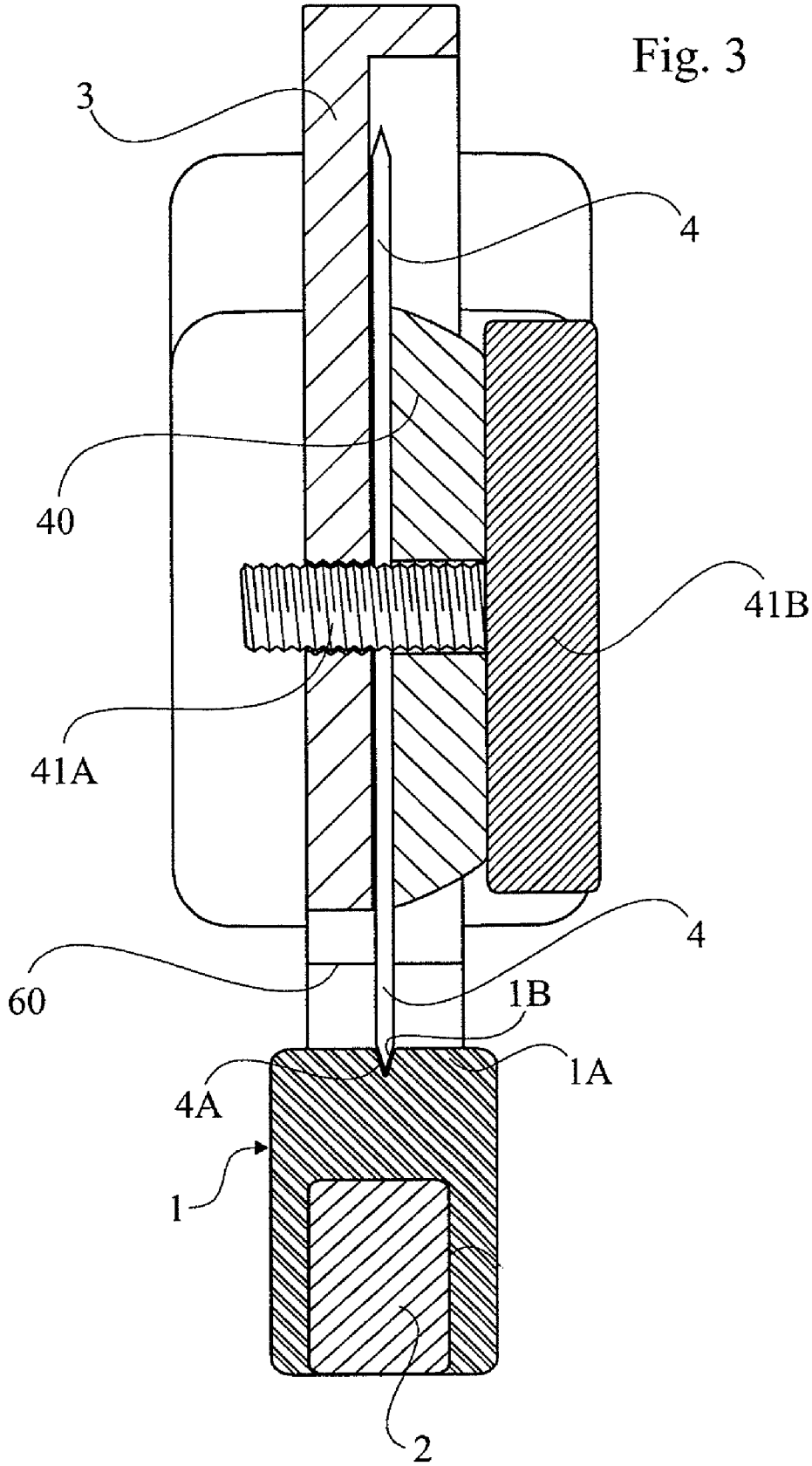
FIG. 3 shows the cutting device partly in section along the line marked III-III in FIG. 1.

The FIGS. 2-6 show different views of the same embodiment of the cutting device according to the invention. In FIG. 3 is illustrated how the cutting element 4 has made a slit in support surface of the sleeve 1. The screw 41 has in this example a threaded portion which when mounted will reach through the bottom part of the recess 30. Possibly a cover (not shown) may be provided for covering the protruding end of the threaded portion 41A, which cover may be a loose detail or form an integral part of the main body 6. Moreover, the cover could be the part provided with threads in the cavity.

FIG. 7 shows an exploded view of the same embodiment of the invention as in the previous figures. The main body 6 including the handle structure and the integrated cutting head can for instance be milled in one piece in aluminium which gives low weight, strength and balance. Other materials and manufacturing methods can also be used according to the above. The total number of parts making up the cutting device is very small as can be seen, especially if only the cutting head is considered. The design of the different parts of the head as well as the way of fixing them together (only one screw provided with a knurled head for securing and unscrewing without tools) makes it easy to dismount the head e.g. for cleaning purposes.

The invention is not delimited to what has been described above but may be varied within the scope of the appended claims. Hence the skilled person realises that many modifications may be preformed regarding many of the features described above, e.g. using different kind of suitable materials, changing some dimension, but still achieve basically the same functionality. For instance it is evident that a cutting device according to the invention may be very efficient to cut skin/fur (e.g. for a hunter) and also much safer than the use of a traditional knife.

The invention claimed is:

1. A hand-held cutting device comprising:

a handle attached to a cutting head;

a cutting element attached to said cutting head; and a guiding and supporting element extending from said cutting head, said guiding and supporting element and said cutting head arranged to form a protecting periphery such that any part of a cutting edge of said cutting element does not protrude outside of said periphery, said guiding and supporting element including a distal portion arranged to form a feed channel together with a portion of said handle and a support device arranged on said guiding and supporting element, which support device is arranged to interact with said cutting edge to improve cut ability, wherein said cutting element is arranged to be non-rotatable and fixedly attached to said cutting head by means of a locking device that provides for at least three different positions and thereby renewing of said cutting edge, and wherein said support device is arranged with a portion made of a softer material than the material of said cutting edge to form a fixed recess interacting with said cutting edge.

2. A hand held device according to claim 1, wherein said portion is provided with a smoothly curved, low friction surface that provides for a substantially clog free converging zone of the feed channel.

3. A hand held device according to claim 1, wherein said support device is in a form of a sleeve arranged to fit on a core element of said guiding and supporting element.

4. A hand held device according to claim 3, wherein said support device is wholly made of said softer material and arranged with a snap-in arrangement to securely attach the sleeve.

5. A hand held device according to claim 1, wherein said guiding and supporting element includes a core element, fixedly attached to the body of the cutting head.

6. A hand held device according to claim 1, wherein said guiding and supporting element includes a core element integral with the body of the cutting head.

7. A hand held device according to claim 1, wherein said cutting element is positioned within a recess of said cutting head, said recess having a first end and a second end such that a sidewall is located adjacent said second end, and wherein said sidewall has at least one bevelled portion to facilitate for the cut material to leave the cutting head without risk of clogging at the exit of the recess.

8. A hand held device according to claim 1, wherein said handle comprises a core portion having at least one through hole for a finger of a user.

9. A hand held device according to claim 8, wherein at least one easily attachable/detachable cover plate is arranged on to said core portion.

10. A hand held device according to claim 8, wherein an integral glide stop is arranged at a distal end of said core portion.

* * * * *